United States Patent [19]

Nakamura et al.

[11] 4,084,969

[45] Apr. 18, 1978

[54] COLOR PHOTOGRAPHIC PROCESS

[75] Inventors: Koichi Nakamura; Isao Shimamura, both of Minami-ashigara, Japan

[73] Assignee: Fuji Photo Film Co., Ltd., Minami-ashigara, Japan

[21] Appl. No.: 750,342

[22] Filed: Dec. 13, 1976

[30] Foreign Application Priority Data

Dec. 12, 1975 Japan ..... 50-148004

[51] Int. Cl.[2] ..... G03C 5/32; G03C 1/06

[52] U.S. Cl. ..... 96/60 R; 96/95

[58] Field of Search ..... 96/60, 22, 95

[56] References Cited

U.S. PATENT DOCUMENTS

| | | | |
|---|---|---|---|
| 3,765,891 | 10/1973 | Travis | 96/55 |
| 3,841,873 | 10/1974 | Mowrey et al. | 96/22 |
| 3,846,130 | 11/1974 | Purol et al. | 96/22 |
| 3,923,511 | 12/1975 | Bissonette | 96/60 BF |

*Primary Examiner*—Mary F. Kelley

*Attorney, Agent, or Firm*—Sughrue, Rothwell, Mion, Zinn and Macpeak

[57] ABSTRACT

In a color photographic process wherein a color photographic material having at least one silver halide emulsion layer is developed after imagewise exposure in a color developer containing a primary aromatic amine color developing agent to form dye images, the intensification effect of the color images formed is increased with less formation of fog by employing silver iodobromide containing at least about 2 mole percent silver iodide as the silver halide of the silver halide emulsion and developing the silver halide emulsion layer in the presence of a cobalt (III) complex incorporated in the photographic material or a processing solution at temperatures of about 50° C or higher.

21 Claims, No Drawings

COLOR PHOTOGRAPHIC PROCESS

BACKGROUND OF THE INVENTION

1. Field of the Invention

The present invention relates to a color photographic process for a silver iodobromide (containing at least about 2 mole percent silver iodide) color photographic material and, more particularly, it relates to a color photographic process of performing color intensification (the intensification of dye image densities) in the presence of a cobalt (III) complex at high temperatures of about 50° C or higher.

2. Brief Description of the Prior Art

A color photographic material generally contains from about 1 g to about 15 g of silver halide per square meter of the photographic material. For example, a photographic color negative film or a photographic color reversal film ordinarily contains about 3 to 9 g of silver halide per square meter of the photographic film. Silver or silver halide used in the color photographic film is inevitably consumed in obtaining desirable dye image densities but if it is possible to reduce the amount of silver or silver halide used in the color photographic material without reducing the photographic properties of the photographic material, conservation of silver resources and a reduction in the costs of color photographic materials as well as the costs for processing them can be obtained, which enables commercial photographic products having high quality at a comparatively low cost to be provided.

Therefore, several attempts have been proposed for reducing the amount of silver to be used. A typical example of such an attempt is an intensification of the color images using a peroxide such as hydrogen peroxide as disclosed in U.S. Pat. No. 3,674,490 and a metal complex such as a cobalt (III) complex as disclosed in U.S. Pat. Nos. 3,856,524 (corresponding to Japanese Patent Application (OPI) No. 9728/1973), 3,765,891 and 3,748,138.

However, various difficulties are encountered in the intensification of color images using a peroxide such as hydrogen peroxide. First, a peroxide is very unstable in an aqueous solution. Second, when the period of time required for the intensification is prolonged, the dye images formed are damaged. Third, the performance of the intensification is accompanied by the formation of a large amount of fogging.

On the other hand, the intensification using a metal complex is superior to the intensification using a peroxide from the standpoint that the metal complex is stable as compared with the peroxide but the intensification effect using such a metal complex is much lower than that using peroxide.

Furthermore, a disadvantage common to both attempts exists. That is, the above-described intensification attempts show hardly any intensification effect for color photographic materials for photography (i.e., highly sensitive color photographic materials using silver iodobromide containing more than about 2 mole percent silver iodide, generally more than 3 mole percent, for example 5 to 7 mole percent, silver iodide as the light-sensitive element. This is particularly marked in the intensification of color images using a cobalt (III) complex.

Example 1 of U.S. Pat. No. 3,748,138, described above, discloses that silver image densities can be intensified by processing a silver iodobromide photographic material containing 6 mole percent iodide in a black and white developer containing a cobalt (III) complex at 24° C. Furthermore, Example 1 (amended) of Japanese Patent Application (OPI) No. 9728/1973 discloses that dye image densities are intensified by processing a silver iodobromide photographic material containing about 2 mole percent iodide in a color developer containing a cobalt (III) complex at 24° C.

However, when attempts to follow the same disclosure on a silver iodobromide photographic material containing 2 mole percent iodide using the color developer having the same composition as above were made, no intensification effect was obtained.

Thus, since the intensification effect with the same cobalt (III) complex differs greatly depending on whether a black and white development or a color development is carried out, then it can be understood that the intensification technique obtained in a black and white development system will be inapplicable to a color development system.

It is quite incomprehensible that when a silver iodobromide color photographic material containing about 1 mole percent iodide is processed at temperatures of about 30° C in the presence of a cobalt (III) complex, a color intensification effect is obtained (see, Example 10 of U.S. Pat. No. 3,765,891 described above), while when a silver iodobromide color photographic material containing a comparatively large amount of iodide, i.e., more than 2 mole percent iodide, is processed under the same condition as above, a color intensification effect is hardly obtained.

The mechanism of the color intensification using, in particular, a metal complex such as a cobalt (III) complex has not yet been clarified, and there has been no technique nor idea for achieving color intensification in processing a silver iodobromide color material containing more than about 2 mole percent iodide for photography and hence a solution to the above-described problem has been an important subject in the art.

SUMMARY OF THE INVENTION

A primary object of this invention is, therefore, to provide a novel color photographic process for color-intensifying silver iodobromide color photographic materials each containing at least about 2 mole percent iodide in the presence of a cobalt (III) complex.

As the result of various investigations, it has now been discovered that the above object of this invention can be effectively attained by the present invention, which provides a color photographic process for forming dye images by processing, after imagewise exposure, a silver iodobromide photographic material containing at least about 2 mole percent iodide (preferably 3 to 10 mole percent iodide) and less than about 98 mole percent bromide in at least one layer thereon in a color developer in the presence of a primary aromatic amine color developing agent, in which a cobalt (III) complex is incorporated in the photographic material or a processing solution and the photographic material is processed at temperatures higher than about 50° C, preferably 60° to 80° C for causing the oxidation reduction reaction of the cobalt (III) complex with the color developing agent in the presence of developed silver as the catalyst.

DETAILED DESCRIPTION OF THE INVENTION

The temperature for photographic processing usually employed in "high-temperature processing" is about 37° C (the temperature is about 35° to 40° C with ME-4 processing as described in *Manual for Processing of Kodak and Eastman Echtachrome Films using Process ME*-4 (Motion Picture and Audio = visual Markets Division, Rochester) H 33, 1975) and photographic processing at temperatures over 50° C is limited to specific uses, such as a black and white development process for aerial photography. That is, photographic processing at such a high-temperature has not hitherto been employed for general photographic purposes. As stated above, the temperature for color photographic processing usually employed is lower than about 40° C.

It is completely unexpected that, while a color intensification effect is hardly obtained at a processing temperature of about 30° to 40° C as in the conventional technique, a color intensification effect arises suddenly when the temperature of the color photographic processing exceeds about 50° C since it is known that if the processing temperature is increased, the processing speed can generally be increased but the relationship between the processing temperature and the color intensification effect (i.e., the increase of dye image densities) has not been clarified. Also, another reason is that when a silver iodobromide photographic material containing a comparatively large amount of iodide, such as more than about 2 mole percent, is developed, a considerable amount of iodide ion is released and adsorbed on the developed silver to act as a catalyst poison to the above-described oxidation reduction reaction and it is considered to be difficult to desorb the iodide thus adsorbed even when the processing temperature is increased.

In other words, the factor of "processing at temperatures higher than about 50° C" is not based on a simple discovery of optimum processing conditions. The feature of or the significance of the present invention is that a color intensification which can not be obtained by conventional techniques can be obtained by the combination of the use of the specific kind of silver halide and a cobalt (III) complex (a color intensifier) and the use of the specific conditions, i.e., a processing at temperatures higher than about 50° C.

Moreover, it has also been discovered that by performing the photographic processing of this invention in the presence of a cobalt (III) complex and about 0.5 to 20 g/liter, in particular, 1 to 10 g/liter, of a bromide such as potassium bromide, sodium bromide, ammonium bromide, etc., the intensification effect of the dye images can be even further increased and the formation of fog can be greatly suppressed.

The cobalt (III) complex used in this invention preferably is a tri-valent cobalt complex which exhibits a difficult ligand exchange reaction and is inert. In general, the cobalt (III) complex is prepared prior to use and cobalt (III) complexes having various ligands can be used in this invention. Almost all kinds of Lewis bases (i.e., materials possessing an unshared electron pair) can be the ligand (the coordinating atom is, for example, a nitrogen atom, a sulfur atom or an oxygen atom and the ligand may have a single coordinating atom or two or more coordinating atoms in the molecule). Typical examples of the ligands are described in, for example, Basolo and Peason, *Mechanisms of Inorganic Reactions; A. Study of Metal Complexes and Solutions,* 2nd Ed., page 141, John Wiley and Sons Co., (1967). Further, cobalt complexes are additionally exemplified in U.S. Pat. Nos. 3,698,525, 3,656,950, 3,748,138, 3,816,134, 3,765,891, 3,834,907, 3,822,129, 3,847,619, 3,856,524, 3,862,855, 3,826,652, 3,841,873, 3,846,130, and 3,862,842, German Pat. Application (OLS) Nos. 2,226,770, 2,250,050, 2,248,906, 2,357,685, 2,357,694, 2,360,327, 2,360,326, 2,419,825, 2,360,327, 2,360,326, 2,516,174 and 2,516,188, Belgian Pat. Nos. 807,890, 807,568, French Pat. No. 2,245,980, Japanese Pat. application (OPI) Nos. 9728/73, 9729/73, and Research Disclosure Vol. 127, 12717 (1974); Ibid, Vol. 133, 13313 (1975); Ibid, Vol. 135, 13527 (1975); Ibid, Vol. 135, 13551 (1975); Ibid, Vol. 139, 13927 (1975); and Ibid, Vol. 136, 13630 (1975).

A particularly preferred cobalt (III) complex has a coordination number of 6 per cobalt atom with ligands being selected from the group consisting of ammine ($NH_3$), ethylenediamine, propylenediamine, diethylenetriamine, triethylenetetramine, nitrate, nitrite, azide, halide (e.g., bromide, fluoride, chloride, etc.), thiocyanate, isothiocyanate, water ($H_2O$), and carbonate. A suitable cobalt (III) complex has (1) at least 5 ammine ligands, (2) at least 2 ethylenediamine ligands or trimethylenediamine ligands, or (3) one triethylenetetramine ligand or diethylenetriamine ligand. A particularly useful cobalt (III) complex is represented by the formula (A)

$$[Co(NH_3)_6]_nX_m \quad (A)$$

wherein X is Cl, Br, $ClO_4$, $CH_3COO$, or $NO_3$ when $n$ is 1 and $m$ is 3 or is $SO_4$ or $CO_3$ when $n$ is 2 and $m$ is 3.

Another example of a particularly useful cobalt (III) complex is represented by the formula (B)

$$[Co(NH_3)_5L]Y \quad (B)$$

wherein L is $H_2O$, OH, Cl, Br, NCS, SCN, or $NO_3$ and Y is the same anion as X in the above general formula (A), the number of the anions being determined so as to achieve electrical neutrality or shown by the formula (C)

$$[Co(tmd)_2L']Y \quad (C)$$

wherein L' is $Cl_2$, $Br_2$, $(NO_3)_2$, $CO_3$ or $SO_4$; tmd stands for trimethylenediamine; and Y has the same significance as above.

The cobalt (III) complex can be incorporated in a processing solution and/or a photographic material but the complex is most generally incorporated in a processing solution. When the cobalt complex is incorporated in a processing solution, it can be incorporated in a bath (intensification bath) used between the development step and the silver removal step (bleach step and/or fix step) and/or a developer solution. In a specific case, the cobalt (III) complex may be incorporated in a pre-bath employed before the development step. In general, however, the complex is preferably incorporated in the intensification bath.

Also, when the cobalt (III) complex is incorporated in a photographic material, it can be incorporated in one or more silver halide photographic emulsion layers and/or non-photo-sensitive hydrophilic colloid layers such as a protective layer, an interlayer, and a hydrophilic colloid layer directly formed on the support but it is preferably incorporated in a nonphotosensitive hydrophilic colloid layer formed directly or indirectly on a support as described in U.S. Pat. No. 3,847,619 and German Patent Application (OLS) No. 2,357,685 (Corresponding to Japanese Patent Application (OPI) No. 84,229/74). Where the cobalt (III) complex is incorporated into a photographic material, a suitable amount of the cobalt (III) complex can range from about 0.1 to about 15 g/m$^2$, preferably 1 to 10 g/m$^2$.

More practically speaking, it is preferred for a silver iodobromide color photographic material containing at least about 2 mole percent silver iodide, after imagewise exposure, to be brought into contact with an intensification bath containing the cobalt (III) complex in the presence of a primary aromatic amine developing agent at temperatures higher than about 50° C, e.g., up to a temperature which does not deteriorate the photographic emulsion layers, preferably up to about 80° C.

When the cobalt (III) complex is used in the intensification bath between the development step and the silver removal step, only the temperature of the intensification bath needs to be higher than about 50° C and the temperatures of the other processing baths employed in the development step and the silver removal step do not need to always be higher than about 50° C. In the intensification process of this invention wherein the cobalt (III) complex is incorporated in a developer, the temperature of the developer is kept higher than about 50° C. In this case, also the temperatures of other processing baths do not need to always be higher than about 50° C.

When the cobalt (III) complex is incorporated in a processing bath, the amount of the complex used is about 1 to about 100 g per liter of the processing solution, in particular an amount of 2 to 50 g or more, particularly 5 to 30 g per liter of the processing solution. When an intensifier is used, the pH of the intensifying solution is about 7 to about 14, in particular 8 to 13. The intensifying solution can further contain known compounds as addenda for a developing solution in addition to the cobalt (III) complex. Examples of these compounds are alkaline agents, buffers, etc., for the processing composition used in this invention, such as sodium hydroxide, potassium hydroxide, sodium carbonate, potassium carbonate, sodium tertiary phosphate, potassium tertiary phosphate, potassium metaborate, borax, and appropriate combinations thereof. Further, for the purpose of buffering the processing solution, facilitating the preparation of the processing solution, or increasing the ionic strength of the solution, various salts such as disodium hydrogen phosphate, dipotassium hydrogen phosphate, sodium dihydrogen phosphate, potassium dihydrogen phosphate, sodium bicarbonate, potassium bicarbonate, boric acid, an alkali metal nitrate, an alkali metal sulfate, etc. can be used.

The intensifying solution used in this invention can further contain a suitable amount (e.g., in an amount as hereinbefore described) of an antifoggant such as, for example, sodium bromide, potassium bromide, and ammonium bromide. Such an alkali metal or ammonium bromide as an antifoggant can also be incorporated into a developer solution as well.

It is further preferred for a nitrogen-containing heterocyclic compound to be incorporated in the intensifying solution, the developer, and/or the silver halide photographic material used in this invention for greatly reducing the formation of fog. Preferred nitrogen-containing heterocyclic compounds which can be used are those containing a 5- or 6-membered heterocyclic ring which may be fused with an aromatic ring. The heterocyclic ring may also contain an oxygen atom as an additional hetero atom. The 5- or 6-membered heterocyclic ring may contain up to 4 nitrogen atoms as hetero atoms. It is preferred for the nitrogen-containing heterocyclic compound used for the purpose to not have a mercapto group and specific examples of nitrogen-containing heterocyclic compounds are, for example, indazoles, such as 6-nitroindazole as described in U.S. Pat. No. 2,496,940; benzimidazoles such as 5-nitrobenzimidazole; benzotriazoles such as 5-nitrobenzotriazole, 5-methylbenzotriazole, etc., as described in U.S. Pat. Nos. 2,497,917 and 2,656,271; tetrazole; and tetraazaindenes such as 4-hydroxy-6-methyl-1,3,3*a*,7-tetraazaindene.

Moreover, if necessary, the intensifying solution used in this invention can further contain an appropriate development accelerator. Examples of suitable development accelerators are the various pyridinium compounds and other cationic compounds as described in U.S. Pat. No. 2,648,604; Japanese Patent Publication No. 9503/69; and U.S. Pat. No. 3,671,247; cationic dyes such as phenosafranine, etc.; neutral salts such as thallium nitrate and potassium nitrate; polyethylene glycol and derivatives thereof as described in Japanese Patent Publication No. 9504/69 and U.S. Pat. Nos. 2,533,990; 2,531,832; 2,950,970; and 2,577,127; nonionic compounds such as polythioethers; organic solvents and organic amines as described in Japanese Patent Publication No. 9509/69 and Belgian Patent No. 682,862; ethanolamine, ethylenediamine; and diethanolamine. Other examples of development accelerators which can be used in this invention are described in L. F. A., Mason; *Photographic Processing Chemistry,* pages 40–43 Focal Press, London (1966).

Still further, benzyl alcohol and phenylethyl alcohol as described in U.S. Pat. No. 2,515,147 and pyridine, ammonia, hydrazine, and amines as described in *Journal of the Society of Photographic Science and Technology of Japan,* Vol. 14, 74(1952) can be also used as an effective development accelerator.

Moreover, the intensifying solution used in this invention can further contain hydroxylamine sulfate, hydroxylamine hydrochloride, sodium sulfite, potassium sulfite, potassium bisulfite, or sodium bisulfite.

Furthermore, polyphosphoric acid compounds such as sodium hexametaphosphate, potassium hexametaphosphate, sodium tetrapolyphosphate, potassium tetrapolyphosphate, sodium tripolyphosphate, and potassium tripolyphosphate as well as aminopolycarboxylic acids such as ethylenediaminetetraacetic acid, nitrilotriacetic acid, cyclohexanediaminetetraacetic acid, iminodiacetic acid, N-hydroxymethylethylenediaminetriacetic acid, and diethylenetriaminepentaacetic acid can be used in the intensifying solution as a water softener. It is preferred to employ aminopolycarboxylic acids as a water softener. The amount of the water softener depends upon the hardness of the water used to prepare the intensifying solution but is usually about 0.5 to 1 g/liter. Also, other compounds such as masking agents for calcium ion and/or magnesium ion can be used in the intensifying solution. Specific examples of these masking agents are described in J. Willems, *Belgishes Chemiches Industry,* 21, 325 (1956) and ibid., 23, 1105 (1958).

When a color developing agent is used together with the color intensifier, the processing solution containing these components can contain developer components, in particular organic solvents for improving the solubility of the color developing agent. Specific examples of suitable organic solvents are ethylene glycol, hexylene glycol, diethylene glycol, methyl Cellosolve, methanol, ethanol, acetone, triethylene glycol, dimethylformamide, and dimethyl sulfoxide. Other examples are described in Japanese Patent Publication Nos. 33378/72 and 9509/69.

The amount of the organic solvent depends largely on the composition of the processing solution but is usually less than about more 50% by weight, generally less than 10% by weight. Sometimes only organic solvents are used as the solvent for the processing solution.

The color developing agent used in this invention can be incorporated in a processing solution and/or a color photographic material. When the color developing agent is incorporated in a processing solution, it is preferably incorporated in a color developer and/or an intensification solution. When the color developing agent is incorporated in a color photographic material, it is preferably incorporated in silver halide emulsion layers and/or layers adjacent thereto.

The most usual examples of the primary aromatic amine color developing agents which can be used in this invention are p-phenylenediamine derivatives and typical examples of them are N,N-diethyl-p-phenylenediamine hydrochloride, 2-amino-5-diethylaminotoluene hydrochloride, 2-amino-5-(N-ethyl-N-laurylamino)-toluene, 4-ethyl-N-[(β-hydfoxyethyl)amino]aniline sulfate, 2-methyl-4-[N-ethyl-N-(β-hydroxyethyl)amino]aniline sulfate, N-ethyl-N-(β-methanesulfoamidoethyl)-3-methyl-4-aminoaniline sesquisulfate monohydrate described in U.S. Pat. No. 2,193,015, N-(2-amino-5-diethylaminophenylethyl)methanesulfonamide sulfate described in U.S. Pat. No. 2,592,364, N,N-dimethyl-p-phenylenediamine hydrochloride, and 4-amino-3-methyl-N-ethyl-N-methoxyaniline, 4-amino-3-methyl-N-ethyl-N-β-ethoxyaniline, 4-amino-3-methyl-N-ethyl-N-β-butoxyaniline and the salts (e.g., sulfates, hydrochlorides, sulfites, p-toluenesulfonates, etc.) thereof as described in U.S. Pat. Nos. 3,656,950 and 3,698,525. Most preferred examples of p-phenylene diamines are those having an oil-solubilizing group. The oil-solubilizing group is a group which accelerates the solubilization of the color developer into an oil as a solvent for a coupler. Examples of oil-solubilizing groups are, for example, an alkoxy group (e.g., methoxy, ethoxy, propoxy, butoxy, etc.). Other examples are described in *Kagaku Shashin Binran,* Vol. 2, page 72 Maruzen Shuppan Sha (1959) and L. F. A. Mason, *Photographic Processing Chemistry,* pages 226–229, Focal Press, London (1966).

Furthermore, p-aminophenol derivatives can be used as the color developing agent and a typical example of this kind of developing agent is 2-methyl-4-aminophenol.

The primary aromatic amine color developing agent can be used together with an auxiliary developing agent and examples of auxiliary developing agents are 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone, etc.); N-substituted aminophenols such as N-methyl-p-aminophenol, N,N-diethyl-p-aminophenol, N-(p-hydroxyphenyl)pyrrolidine, etc.); NN, N'N'-tetraalkyl-p-phenylenediamines; pyrogallol; catechol; hydroquinone; and various reductones.

The amount of silver coated of the color photographic material can be reduced below about 5 g/m$^2$ with satisfactory results in this invention and, in particular, can be reduced below 3 g/m$^2$. In case of multilayer color photographic material, the amount of silver in a single silver halide emulsion layer is lower than about 2 g/m$^2$, in particular 1 g to 1 mg/m$^2$.

In a typical embodiment of this invention, couplers are incorporated in silver halide emulsion layers of the color photographic material and the amounts of couplers are those sufficient for giving desired color densities. Usually, the amounts of the couplers are more than the equivalent by weight of silver coated (i.e., more than few times the amount of silver used in mole ratio). There is no limitation as to the couplers to be used in this invention.

The couplers incorporated in silver halide emulsion layers have a structure or property such that they do not diffuse into other layers during preparation of the color photographic material or during processing of the color photographic material.

Open-chain type diketomethylene compounds are generally used as yellow couplers. Specific examples of these couplers are described in, for example, U.S. Pat. Nos. 3,341,331; 2,875,057; and 3,551,155; German Patent Application (OLS) 1,547,868; U.S. Pat. Nos. 3,265,506; 3,582,322; and 3,725,072; German Patent Application (OLS) 2,162,899; U.S. Pat. Nos. 3,369,895 and 3,408,194; and German Patent Application (OLS) 2,057,941; 2,213,461; 2,219,917; 2,261,361; and 2,263,875.

5-Pyrazolone compounds are mainly used as magenta couplers but indazolone compounds and cyanoacetyl compounds are also employed. Examples of these magenta couplers are described in, for example, U.S. Pat. Nos. 2,439,098; 2,600,788; 3,062,653; and 3,558,319; British Pat. No. 956,261; U.S. Pat. Nos. 3,582,322; 3,615,506; 3,519,429; 3,311,476; and 3,419,391; Japanese Patent Application Nos. 21454/73 and 56050/73; German Pat. No. 1,810,464; Japanese Patent Publication No. 2016/69; Japanese Patent Application No. 45971/73; and U.S. Pat. No. 2,983,608.

Phenol derivatives or naphthol derivatives are mainly used as cyan couplers and examples of these couplers are described in, for example, U.S. Pat. Nos. 2,369,929; 2,474,293; 2,698,794; 2,895,826; 3,311,476; 3,458,315; 3,560,212; 3,582,322; 3,591,383; 3,386,301; 2,434,272; 2,706,684; 3,034,892; and 3,583,971; German Patent Application (OLS) 2,163,811; Japanese Patent Publication No. 28836/70; and Japanese Patent Application No. 33238/73.

The coupling reaction in this invention can be carried out in the presence of development inhibitor releasing type couplers (the so-called DIR couplers) or compounds capable of releasing development inhibitors. Examples of these couplers and compounds are described in U.S. Pat. Nos. 3,148,062; 3,227,554; 3,253,924; 3,617,291; 3,622,328; and 3,705,201; British Pat. No. 1,201,110; and U.S. Pat. Nos. 3,297,445; 3,379,529; and 3,639,417.

The above-described couplers can, if necessary, be incorporated in a single silver halide emulsion layer as a combination of two or more couplers for meeting the characteristics required in the color photographic material or the same kind of coupler can be incorporated in two or more silver halide emulsion layers for the same purpose as above.

It is preferred for the coupler to be dispersed in an emulsion as oil droplets of a solution thereof in a coupler solvent which preferably has the following four characteristics as an oil:

(1) is liquid at room temperature (about 25° C),
(2) has a boiling point of more than about 150° C (preferably 200° C or above) at atmospheric pressure,
(3) has a solubility in water of less than about 10% by weight at 25° C, and
(4) has a solubility of water in the oil of less than about 5% by weight at 25° C.

Examples of suitable coupler solvents which can be used for this purpose are alkylphthalates (e.g., dibutylphthalate, dioctylphthalate, etc.), phosphoric esters (e.g., diphenylphosphates, triphenylphosphate, tricresylphosphate, diactylbutylphosphate, etc.), citric esters (e.g., tributylacetylcitrate, etc.), benzoic esters (e.g., octylbenzoate, etc.), alkylamides (e.g., diethyllaurylamide, etc.), phenols (e.g., 2,4-dialkylphenol, etc.) as described in U.S. Pat. No. 2,322,027. It is believed that the coupler solvent contained in a color photographic material acts to accelerate the absorption of color developer during the processing step of transferring the color photographic material from a color developer to an intensification bath.

Preferably the maximum absorption band of a cyan dye formed is in the region between about 600 mμ and about 680 mμ, the maximum absorption band of a magenta dye formed is in the region between about 500 mμ and about 580 mμ, and the maximum absorption band of a yellow dye formed is in the region between about 400 mμ and about 480 mμ.

The silver halide photographic emulsion used in this invention can be subjected to a color sensitization or supersensitization using cyanine dyes such as cyanine, merocyanine, carbocyanine, etc., or a combination of these cyanine dyes, or further a combination of these cyanine dyes and styryl dyes. These dye sensitizing techniques are well known and are discribed in, for example, U.S. Pat. Nos. 2,493,748; 2,519,001; 2,977,229; 3,480,434; 3,672,897; 3,703,377; 2,688,545; 2,912,329; 3,397,060; 3,615,635; and 3,628,964; British Pat. Nos. 1,195,302; 1,242,588; and 1,293,862; German Pat. Application (OLS) 2,030,326; and 2,121,780; Japanese Pat. Publication Nos. 4936/68; 14030/69; and 10773/68; U.S. Pat. Nos. 3,511,664; 3,522,052; 3,527,641; 3,615,613; 3,615,632; 3,617,295; 3,635,721; and 3,694,217; and British Pat. Nos. 1,137,580 and 1,216,203.

The technique is selected depending on the wave length region to be sensitized, the sensitivity desired, the purpose or use of the color photographic material, etc.

The developer used in this invention can contain known components for a developer. Examples of such components are the compounds described herein before in regard to the components for a developer which can be incorporated in the intensifying solution.

The color developer used in this invention can further contain, if necessary, the following additives.

Examples of these additives include competing couplers such as citrazinic acid, J-acid, and H-acid as described in Japanese Patent Publication Nos. 9505/69; 9506/69; 9507/69; 14036/70; and 9508/69 and U.S. Pat. Nos. 2,742,832; 3,520,690; 3,560,212; and 3,645,737; and also fogging agents such as an alkali metal borohydride; amineborane, ethylenediamine, etc., as described in Japanese Patent Publication No. 38816/72.

Typical examples of color developers comprising the above described various components are shown in Kagaku Shashin Binran, page 72, published by Maruzen Shuppan Sha (1959).

In a typical embodiment of the photographic process of this invention, a color photographic material imagewise exposed is developed, intensified with a cobalt (III) complex, fixed, washed with water, and dried to give color images having a high density.

In another embodiment of the color photographic process of this invention, a color photographic material, imagewise exposed, is developed, intensified, bleached followed by fixing (or blixed), washed with water, and dried to give color images. The color photographic material can after intensification, be washed with water and bleached (omitting a fix step).

Also, in still another embodiment of the process of this invention, a color photographic material containing a primary aromatic amine color developing agent in silver halide emulsion layers or layers adjacent the silver halide emulsion layers is, after imagewise exposure, processed in an alkaline intensifying solution containing a cobalt (III) complex without processing by a color developer to perform simultaneously the development of the silver halide emulsion layers and the intensification of dye images formed, bleached and fixed (or blixed), washed with water, and dried to give color images.

In an even further embodiment of the process of this invention, a color photographic material containing a primary aromatic amine color developing agent in the silver halide emulsion layers or layers adjacent the silver halide emulsion layers are, after imagewise exposure, processed in an intensifying solution containing a fixing agent therein to accomplish a so-called monobath type development, intensification, and fixing, rinsed, and dried to give color images. As a modification of this embodiment, a mono-bath type development, intensification, and stabilization processing can be applied without need for water washing and rinsing.

In still another embodiment of the process of this invention, a color photographic material is, after imagewise exposure, developed, intensified, fixed without applying a bleach step, washed with water and dried to give color images. This embodiment is suitable for X-ray color photographic materials.

With a color photographic material containing a particularly small amount of silver, the photographic material can be after development, intensified, washed with water, and dried.

In still another embodiment of the process of this invention, couplers can be incorporated in color developers. Examples of diffusible couplers which can be used in color developers are the cyan couplers as described in U.S. Pat. Nos. 3,002,836 and 3,542,552; the magenta couplers as described in Japanese Patent Publication No. 13111/69; and the yellow couplers as described in U.S. Pat. No. 3,510,306. In this case, the concentration of each coupler is about 0.5 to about 5 g/liter, in particular about 1 to about 2.5 g/liter.

Dye images by the subtractive color process are formed by the color photographic negative process as described in W. T. Hansen and W. I. Kesner, Journal of the Society of Motion Picture and Television Engineers, Vol. 61, 667–701 (1953) or by a color reversal process wherein a color photographic material having negative silver halide emulsion layers which can form negative images upon development in a black and white developer, after imagewise exposure, is imagewise exposed, developed in a black and white developer, exposed again at least once (or alternatively subjected to another fogging treatment), and then further color developed to form desired dye images by the subtractive color process, whereby reversal silver images are formed. In this case, in general, a bleach step is employed after the black and white development and an intensification step is employed after the color development for preventing silver formed in the black and white development from becoming a catalyst.

The invention is further described in greater detail by referring to the following examples. Unless otherwise indicated herein, all parts, percents, ratios and the like are by weight.

EXAMPLE 1

A color photographic film was prepared by coating on a cellulose triacetate film support a red-sensitive silver iodobromide emulsion layer (containing 6 mole percent silver iodide) containing 100 mg/m$^2$ of silver, 700 mg/m$^2$ of gelatin, and 300 mg/m$^2$ of 2-[α-(2,4-di-t-amylphenoxy)butyramido]-4,6-dichloro-5-methylphenol as a cyan coupler dispersed in 150 mg of n-butyl phthalate.

The color photographic film thus prepared was sensitometrically exposed (25 CMS) and subjected to the following processings:

| | | |
|---|---|---|
| Color Development | 40° C | 1 min. |
| Intensification | 30 – 80° C | 30 sec. to 40 min. |
| Blix | 40° C | 1 min. |
| Wash | 26° C | 1 min. 30 sec. |

The compositions of the processing solutions used in the above processings were as follows:

| | |
|---|---|
| **Color Developer** | |
| Benzyl Alcohol | 15 ml. |
| Potassium Sulfite | 4 g |
| Potassium Bromide | 0.5 g |
| Hydroxylamine Sulfate | 2 g |
| 4-Amino-N-ethyl-N-(2-methoxyethyl)-m-toluidine di-p-toluenesulfonate | 7.5 g |
| Potassium Carbonate | 30 g |
| Ethylenediamine Tetraacetic acid Di-sodium Salt | 5 g |
| Water to make | 1 liter (pH 10.1) |
| **Intensification Solution** | |
| Benzyl Alcohol | 15 ml |
| Potassium Bromide | 4 g |
| Potassium Carbonate | 7.5 g |
| $[Co(NH_3)_6]Cl_3$ | 10 g |
| Ethylenediamine Tetraacetic Acid Di-sodium Salt | 10 g |
| Potassium Sulfite | 2 g |
| Water to make | 1 liter (pH 10.1) |
| **Blix Solution** | |
| Ethylenediamine Tetraacetic Acid Di-sodium Salt | 5 g |
| Acetic Acid (glacial) | 20 g |
| Ammonium Thiosulfate (70% aq. soln) | 150 ml |
| $[Co(NH_3)_6]Cl_3$ | |
| Potassium Sulfite | 15 g |
| Water to make | 1 liter (pH 4.5) |

The results obtained are shown in the following table, in which the numerical values given are the maximum densities.

Table 1

| Color Intensification Temperature | Processing Time 30 Sec. | 1 min. | 2 min. | 4 min. |
|---|---|---|---|---|
| 30° C | 0.51 | 0.84 | 0.97 | 1.17 |
| 40° C | 0.53 | 0.86 | 1.01 | 1.21 |

Table 1-continued

| Color Intensification Temperature | Processing Time 30 Sec. | 1 min. | 2 min. | 4 min. |
|---|---|---|---|---|
| 50° C | 0.76 | 1.08 | 1.34 | 1.43 |
| 60° C | 0.90 | 1.27 | 1.65 | 1.80 |
| 70° C | 1.16 | 1.68 | 1.98 | 2.07 |
| 80° C | 1.20 | 1.73 | 2.01 | 2.10 |
| 40° C without $[Co(NH_3)_6]Cl_3$ | 0.56 | 0.87 | 1.03 | 1.20 |

As is clear from the results shown in the above table, the image density formed in using the intensifying solution containing $[Co(NH_3)_6]Cl_3$ was almost the same as that in case of using the intensifying solution not containing $[Co(NH_3)_6]Cl_3$ when the intensification was carried out at temperatures lower than 40° C, while the image density in the former case was higher than that in the latter case when the intensification was carried out at temperatures of 50° to 80° C.

EXAMPLE 2

By following the same procedure as in Example 1 except that the content of silver iodide differed, 7 kinds of similar color photographic materials were prepared. The content of silver bromide in these samples was 2 mole percent, 4 mole percent, 6 mole percent, 8 mole percent, and 10 mole percent respectively. The processing steps were the same as those in Example 1 but the intensification was carried out at 60° C for one minute. The compositions of the processing solutions were exactly the same as those in Example 1 (Processing A). For comparison, the same processing as above was repeated except that the intensification step was carried out at 40° C for 3 minutes (Processing B) or the above described processing was carried out using, however, an intensification solution which was not contain $[Co(NH_3)_6]Cl_3$ (Processing C). The results obtained are shown in the following table, in which the numerical values stand for the maximum density values.

Table 2

| Processing | AgI Mol % 2 | 4 | 6 | 8 | 10 |
|---|---|---|---|---|---|
| A | 1.54 | 1.36 | 1.27 | 1.13 | 1.03 |
| B | 0.98 | 0.92 | 0.89 | 0.66 | 0.54 |
| C | 0.96 | 0.94 | 0.88 | 0.67 | 0.54 |

As is clear from the results shown in Table 2, Processing B and Processing C resulted in almost the same density, while in Processing A of this invention wherein the intensification was carried out at 60° C, the densities were remarkably high.

EXAMPLE 3

A multilayer color photographic material was prepared by coating, in succession, on a cellulose triacetate film a redsensitive silver iodobromide emulsion (containing 7 mole percent silver iodide) having admixed therewith 1-hydroxy-4-chloro-2-n-dodecylnaphthamide as a cyan coupler, a green-sensitive silver iodobromide emulsion (containing 6 mole percent silver iodide) having admixed therewith, 1-(2',4',6'-trichlorophenyl)-3-[3''-(2''',4'''-di-t-amylphenoxyacetamido)benzamido]-5-pyrazolone as a magenta coupler, a yellow filter layer containing a yellow dye, Tartrazine, and a blue-sensitive silver iodobromide emulsion (containing 6 mole percent silver iodide) having admixed therewith, α-(2-methylbenzoyl)-aceto-(2'-chloro-5'-dodecoxycarbonyl-)anilide as a yellow coupler.

In addition, in preparing the silver halide emulsions containing the couplers, dibutyl phthalate and tricresyl phosphate were employed as the solvent for the couplers, sorbitan monolaurate and sodium dodecylbenzene sulfonate were used as an emulsifier, and further sodium 1-(p-nonylphenoxytrioxyethylene)butane-4-sulfonate and a lauric acid ester of sucrose were used as a coating aid.

The color photographic films thus prepared were imagewise exposed for 1/50 sec and processed as follows.

| Processing Step | | |
|---|---|---|
| Color development | 40° C | 1 min. |
| Rinse | 26° C | 5 sec. |
| Intensification | 60° C | 2 min. |
| Blix | 40° C | 3 min. |
| Wash | 26° C | 3 min. |
| Stabilization | 26° C | 1 min. |

The compositions of the processing solutions used in the above processing steps were as follows:

| Color Developer | |
|---|---|
| Benzyl Alcohol | 10 ml |
| Diethylenetriamine Pentaacetic Acid | 5 g |
| Potassium Carbonate | 30 g |
| Potassium Bromide | 2 g |
| Hydroxylamine Sulfate | 2 g |
| 4-Amino-N-ethyl-N-(2-methoxyethyl)-m-toluidine di-p-toluenesulfonate | 7.5 g |
| Water to make | 1 liter (pH 10.0) |
| **Intensification Solution** | |
| Benzyl Alcohol | 10 ml |
| Potassium Bromide | 2 g |
| Potassium Carbonate | 7.5 g |
| $[Co(NH_3)_6]Cl_3$ | 10 g |
| Diethylenetriamine Pentaacetic Acid | 10 g |
| Potassium Sulfite | 2 g |
| Water to make | 1 liter (pH 10.0). |
| **Blix Solution** | |
| Iron (III) Ethylenediamine Tetraacetic Acid Ammonium Salt | 60 g |
| Ethylenediamine Tetraacetic Acid Ammonium Salt | 5 g |
| Ammonium Bromide | 20 g |
| Ammonium Thiosulfate (70% aq. soln) | 150 ml |
| Sodium Sulfite | 5 g |
| Water to make | 1 liter (pH 6.0) |
| **Stabilization Solution** | |
| Formaldehyde | 5.0 ml |
| Dry Well (trade name, made by Fuji Photo Film Co.) | 10 ml |
| Water to make | 1 liter |

In this case, a comparative processing wherein an intensification solution containing no $[Co(NH_3)_6]Cl_3$ was used and another comparative processing wherein the intensification was carried out for 2 minutes or 5 minutes at 40° C. was employed in the same processing steps as above. The results obtained are shown in the Table 3 below.

Table 3

| Test No. | Temp. of Intensification | Intensifying Time | Maximum Density Red | Green | Blue |
|---|---|---|---|---|---|
| 1 | 60° C | 2 min. | 3.41 | 3.06 | 3.14 |
| 2 | 60° C (control)* | 2 min. | 2.52 | 2.14 | 2.35 |
| 3 | 40° C | 2 min. | 2.43 | 2.02 | 2.27 |
| 4 | 40° C | 5 min. | 2.51 | 2.09 | 2.34 |

(*):$[Co(NH_3)_6]Cl_3$ was not incorporated in the intensifying solution.

As is clear from the results shown in the above table, the maximum density in Test No. 3 and Test No. 4 in which the intensification step was carried out at 40° C was at most the same as that in the processing wherein $[Co(NH_3)_6]Cl_3$ was not added to the intensification solution, while in Test No. 1 of this invention wherein the intensification was carried out at 60° C, the density was remarkably high. Also, it can be understood that the prolongation only of the processing period of time could not intensify the image density.

EXAMPLE 4

A color photographic material having a silver halide emulsion layer containing a red-sensitive silver bromoiodide emulsion (containing 3.2 mole percent silver iodide) and a cyan coupler having the following structure

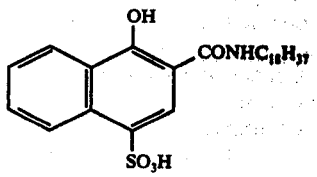

at a coverage of 300 mg/m² of silver was sandwiched between fluorescent screens comprising calcium tungstenate and exposed to X-rays. The color photographic material was processed as follows:

| Processing Steps | | |
|---|---|---|
| Color Development | 60° C | 15 sec. |
| Intensification | 60° C | 30 sec. |
| Fix | 60° C | 15 sec. |
| Wash | 60° C | 30 sec. |
| **Color Development** | | |
| Benzyl Alcohol | | 10 ml |
| Diethylenetriamine Pentaacetic Acid | | 5 g |
| Potassium Sulfite | | 4 g |
| Potassium Carbonate | | 30 g |
| Hydroxylamine | | 2 g |
| 1-Phenyl-3-pyrazolidone | | 1 g |
| 4-Amino-N-ethyl-N-β-hydroxyethyl-m-toluidine Sulfate | | 14 g |
| Potassium Bromide | | 4 g |
| 6-Nitrobenzimidazole | | 0.3 g |
| Water to make | | 1 liter (pH 11.5) |
| **Intensifying Solution** | | |
| Benzyl Alcohol | | 10 ml |
| Potassium Carbonate | | 10 g |
| $[Co(NH_3)_6]Cl_3$ | | 30 g |
| Ethylenediamine Tetraacetic Acid Di-sodium Salt | | 10 g |
| Potassium Sulfite | | 4 g |
| 6-Nitrobenzimidazole | | 0.2 g |
| Water to make | | 1 liter (pH 11.5) |
| **Fix Solution** | | |
| Sodium Sulfite | | 4 g |
| Sodium Bisulfite | | 4 g |
| Ammonium Thiosulfate (70% soln) | | 100 ml |
| Water to make | | 1 liter (pH 6.5) |

For comparison, the same procedure as above was followed except that an intensifying solution which did not contain $[Co(NH_3)_6]Cl_3$ was used. The results obtained are shown in the following table.

Table 4

| Intensification Bath | Characteristic Fog | Gamma | Maximum Density |
|---|---|---|---|
| $[Co(NH_3)_6]Cl_3$ Present | 0.14 | 3.2 | 3.14 |

Table 4-continued

| Intensification Bath | Characteristic | | |
|---|---|---|---|
| | Fog | Gamma | Maximum Density |
| $[Co(NH_3)_6]Cl_3$ Not Present | 0.14 | 1.4 | 1.83 |

As is clear from the results in the above table, the processing of this invention wherein the cobalt (III) complex salt was used in the intensification step showed excellent color intensification effects and gave X-ray color photographs having less fog and having a high gamma value (i.e., having high hard tone) as compared with a processing in which the cobalt (III) complex was not used.

While the invention has been described in detail and with reference to specific embodiments thereof, it will be apparent to one skilled in the art that various changes and modifications can be made therein without departing from the spirit and scope thereof.

What is claimed is:

1. In a color photographic process wherein an imagewise exposed color photographic material having at least one silver halide photographic emulsion layer is processed by development in the presence of a primary aromatic amine color developing agent to form dye images, the improvement which comprises using silver iodobromide containing at least about 2 mole percent silver iodide as the silver halide in at least one silver halide photographic emulsion layer and performing the processing of the color photographic material at a temperature of 60° to 80° C for causing an oxidation reduction reaction of a cobalt (III) complex present in the color photographic material or in a processing solution with the primary aromatic amine color developing agent.

2. The color photographic process as set forth in claim 1, in which said cobalt (III) complex is present in a processing solution and said processing solution is an intensifying solution or a color developer solution.

3. The photographic process as set forth in claim 2, in which said cobalt (III) complex is present in the intensifying solution and at least the intensification processing of the color photographic material is at temperatures of 60° to 80° C.

4. The photographic process as set forth in claim 1, in which said cobalt (III) complex is present in said processing solution in an amount of about 1 to about 100 g per liter of said processing solution.

5. The photographic process as set forth in claim 1, in which said cobalt (III) complex is present in the color photographic material and is in a non-photosensitive hydrophilic colloid layer thereof.

6. The photographic process as set forth in claim 1, in which the processing of the color photographic material is carried out in the presence of a nitrogen-containing heterocyclic compound.

7. The photographic process as set forth in claim 6, in which said nitrogen-containing heterocyclic compound is present in an intensifying solution or a color developer solution.

8. The photographic process as set forth in claim 6, in which said nitrogen-containing heterocyclic compound is present in the color photographic material.

9. The photographic process as set forth in claim 1, in which the processing of the color photographic material is in the presence of a bromide.

10. The photographic process as set forth in claim 9, in which said bromide is potassium bromide, sodium bromide or ammonium bromide.

11. The photographic process as set forth in claim 1, wherein said photographic material is a multilayer photographic material and said silver iodobromide is present as the silver halide in at least one silver halide photographic emulsion layer thereon.

12. The process of claim 6, wherein the nitrogen-containing heterocyclic compound has a 5- or 6-membered heterocyclic ring which contains up to 4 nitrogen atoms and may contain an oxygen atom as a heteroatom, which ring may be fused with a aromatic ring, but which does not have mercapto group as a substituent.

13. The process of claim 12, wherein the nitrogen-containing heterocyclic compound is a indazole, a benzimidazole, a benzotriazole, a tetrazole, or a tetraazaindene.

14. The process of claim 9, wherein the bromide is an alkali metal bromide.

15. The process of claim 14, wherein the alkali metal bromide is present in an intensifying solution in an amount of about 0.5 to about 20 g per liter of the solution.

16. The process of claim 1, wherein the primary aromatic amine color developing agent is selected from the group consisting of p-phenylenediamines and p-aminophenols.

17. The process of claim 1, wherein the primary aromatic amine color developing agent is selected from the group consisting of p-phenylenediamines having an oil-solubilizing group.

18. The process of claim 2, wherein the intensifying solution further contains a water softener.

19. The process of claim 18, wherein the water softener is selected from the group consisting of polyphosphoric acid compounds and aminopolycarboxylic acids.

20. The process of claim 19, wherein the water softener is an aminopolycarboxylic acid.

21. The photographic process as set forth in claim 1 wherein said silver iodobromide contains 3 to 10 mole percent iodide as the silver halide.

* * * * *